US006269976B1

(12) United States Patent
DeJonge

(10) Patent No.: US 6,269,976 B1
(45) Date of Patent: Aug. 7, 2001

(54) VIAL ACCESS SPIKE ADAPTER FOR PUMP SPRAYER

(75) Inventor: Stuart DeJonge, Easton, PA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/640,550

(22) Filed: Aug. 17, 2000

(51) Int. Cl.[7] ..... B67D 5/00

(52) U.S. Cl. ..... 222/82; 222/83.5; 222/321.7; 222/382

(58) Field of Search ..... 222/82, 83.5, 321.7, 222/382, 464.1

(56) References Cited

U.S. PATENT DOCUMENTS 4,146,153 * 3/1979 Bailen ..... 222/83
4,624,393 * 11/1986 Lopez ..... 222/81
5,163,583 * 11/1992 Whitworth ..... 222/1
5,171,214 * 12/1992 Kolber et al. ..... 604/82
5,279,576 * 1/1994 Loo et al. ..... 604/187
5,307,953 * 5/1994 Regan ..... 222/82
5,433,343 * 7/1995 Meshberg ..... 222/25
5,503,302 * 4/1996 DeJonge ..... 222/82
5,526,853 * 6/1996 McPhee ..... 141/329
5,697,522 * 12/1997 Mayes ..... 222/1
5,891,129 * 4/1999 Daubert et al. ..... 604/411
5,954,104 * 9/1999 Daubert et al. ..... 143/329
6,139,534 * 10/2000 Niedospial, Jr. et al. ..... 604/411
6,145,703 * 11/2000 Opperman ..... 222/82
6,189,580 * 2/2001 Thibault et al. ..... 141/25

* cited by examiner

*Primary Examiner*—Kevin Shaver
*Assistant Examiner*—Frederick C Nicolas
(74) *Attorney, Agent, or Firm*—Dykema Gossett PLLC

(57) ABSTRACT

A vial access spike adapter for connecting a pump dispenser to a vial. The vial access spike adapter is capable of piercing a seal insert in the vial and guiding a dip tube of a pump dispenser into the vial so the contents of the vial can be dispensed directly from the vial. The vial access spike adapter has an upper tubular body with a threaded connection at one end, an annular snap ring connection at the opposite end and a hollow interior throughout. Within the hollow interior, is a central passage used to facilitate the placement of the dip tube into the interior of the vial. A central support is integral with and supports the central passage within the hollow body, and seals the vial access spike adapter to prevent leakage.

5 Claims, 1 Drawing Sheet

VIAL ACCESS SPIKE ADAPTER FOR PUMP SPRAYER

BACKGROUND OF THE INVENTION

This invention relates generally to a device for connecting a conventional dispensing device directly to a vial, and more particularly to an adapter to be used with a fine mist sprayer or pump dispenser so the contents of a vial can be dispensed in a sanitary, convenient, easy fashion without leakage.

There is a need for a device that can adapt a vial into a pump dispenser or fine mist sprayer wherein the contents of the vial can easily be evacuated from the interior thereof with a simple pumping action.

Currently in the market, the contents of vials are extracted through syringes and dispersed or the vial is opened and the contents are poured from the vial into a separate dispensing device.

Drawbacks of the current devices in the art are that they are unsanitary, uneconomical and none allow for the use of pump dispensers or fine mist sprayers. Transferring the contents into a separate vial can also expose the contents to various bacteria, dirt and debris, hence contaminating the contents prior to their being used by the person.

Currently in the art, there exists a device for dispensing flowable material from a bag as disclosed in U.S. Pat. No. 4,776,488 issued to Gurzan. This patent discloses a device connected directly to a bag by placing an annular sealing part within the interior of the bag and having a dispensing part on the exterior of the bag. The dispensing part is interlocked with the annular sealing part and in doing so pierces the bag as well as holds it between the dispensing part and the annular sealing part, forming a passageway from the interior of the bag to the exterior of the bag.

The Gurzan device allows for a bag to be perforated and sealed through the interlocking nature of the dispensing part and the annular sealing part.

Also in the art, is a device for perforating and opening a can of liquid and for sealing the opened can against leakage while coupling a dispenser to the opened can (See U.S. Pat. No. 3,705,666 to Nelson et al.) The Nelson device has a first cylinder for telescoping over a can, and a second cylinder with perforating portion is attached to the first cylinder. One end of the second cylinder is located within the first cylinder and perforates the can as the first cylinder is placed over and around the can. The other end of the second cylinder has attachment means wherein a dispenser gun is attached with a portion thereof being inserted and extending down through the middle of the second cylinder so that the intake portion of the dispenser gun is placed in the lower portion of the can.

While the Nelson device shows a dispensing device used in conjunction with a guiding and perforating unit, it does not have a guiding means for a dip tube, nor is it meant to be used in a sanitary or medical environment.

It is also difficult for elderly or handicapped people to withdraw the contents out of a vial through the traditional means. The vials may be small and difficult to handle for people who are losing motor skills or have debilitating conditions such as arthritis.

SUMMARY OF THE INVENTION

It is an object of the present invention to provide an easy and convenient means of dispensing the contents of a vial.

Another object of the present invention is to provide a sanitary means of dispensing the contents of a vial or container.

Yet another object of the invention is to provide an assembled unit that is leakproof even if tipped over.

The present invention may be used with vials currently known in the art, rendering the device an economically viable solution.

According to the present invention, the vial access spike adapter for a pump dispenser comprises a vial having a seal insert and cover; a vial access spike adapter for connecting a conventional pump dispenser to the vial; the pump dispenser capable of being attached to the vial access spike adapter; and the vial access spike adapter capable of piercing a seal of the seal insert in the vial and allowing the dip tube to be placed within the vial, whereby upon pump actuation, product from within the vial is drawn through the vial access spike adapter and out through the pump dispenser. The vial access spike adapter allows for vials to be converted directly into pump dispensers or fine mist sprayers without requiring any manufacturing changes to the vial or pump dispenser.

Also, the vial access spike adapter itself is comprised of a hollow tube with a connecting means, an annular snap ring, and a central passage means having a piercing tube, wherein the vial access spike adapter is capable of being connected to a pump dispenser and a vial thus allowing for contents of the vial to be easily dispensed directly therefrom.

Other objects, advantages and novel features of the invention will become more apparent from the following detailed description of the invention when taken in conjunction with the accompanying drawings.

DETAILED DESCRIPTION OF THE INVENTION

Figure 1:
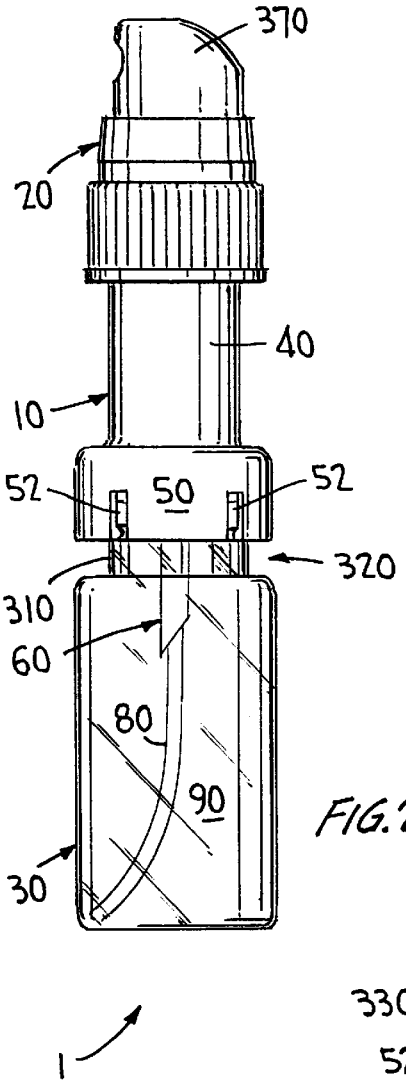
FIG. 1 is a side elevational view of a vial access spike adapter according to the invention as assembled to a vial and a pump dispenser.

In the drawings, like reference characters refer to like and corresponding parts throughout the several views.

Figure 2:
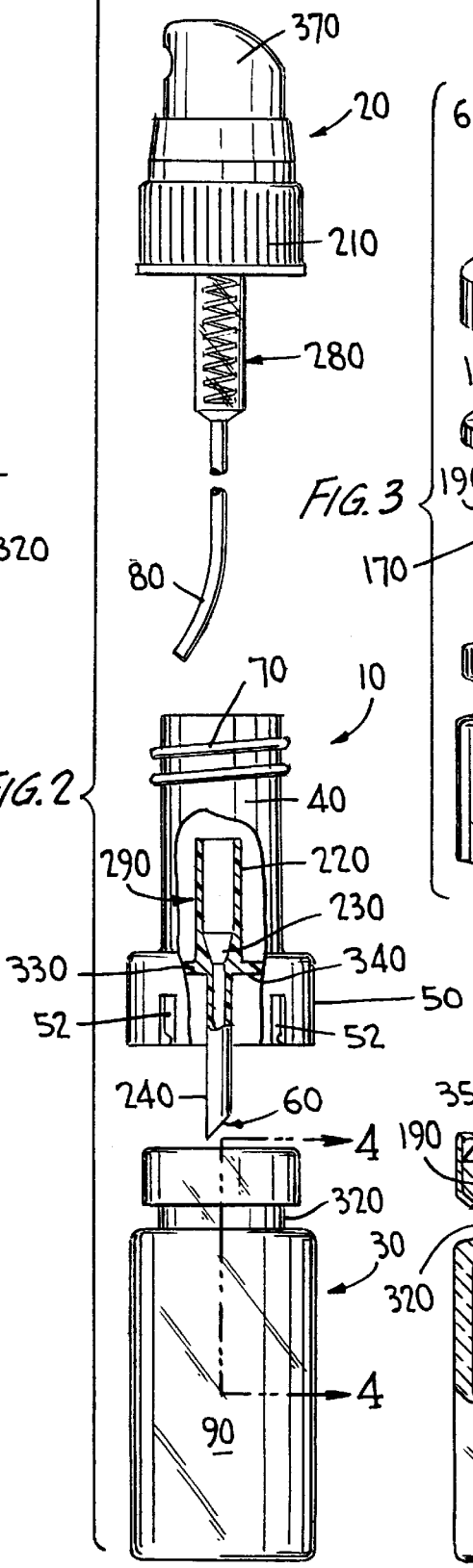
FIG. 2 is an exploded side elevational view of the pump dispenser, spike adapter and vial of FIG. 1, a portion of the spike adapter being broken-away to show the piercing tube.

Referring to FIGS. 1 and 2, the vial access spike adapter 10 has a pump dispenser 20 connected to one end thereof. The opposite end of the vial access spike adapter 10 is connected to a vial 30 containing any one of a variety of liquid pharmaceuticals. While in the present embodiment a vial 30 is shown and described, it is envisioned that any type of conventional container of similar structure can be used without departing from the invention. The vial access spike adapter 10 allows a conventional pump dispenser 20 to be connected to the vial 30 so that the contents of the vial 30 can be expelled from the interior thereof in a clean, sanitary, efficient, economical and easy manner.

The pump dispenser 20 can be of any conventional type known in the art having a closure 210 for connecting the pump dispenser 20 to the vial access spike adapter 10. The pump dispenser also has a standard pumping mechanism 280 with a dip tube 80 extending therefrom.

The dip tube 80 extends into the interior of the vial 30 so that, as shown in the art, the contents can be suctioned up through the dip tube 80 and dispensed from the sprayer upon pump actuation. The adapter 10 is sealed in such a manner as to prevent unnecessary leaking and spillage when the pump dispenser 20 is assembled with the vial access spike adapter 10 and the vial 30 itself.

The vial access spike adapter 10 has an upper hollow tube body 40 with connecting means 70 at one end. The connecting means 70, such as a threaded end, correspond to connecting means, such as a threaded collar 210 on the pump dispenser 20 so that the pump dispenser 20 can be connected to the vial access spike adapter 10.

Figure 3:
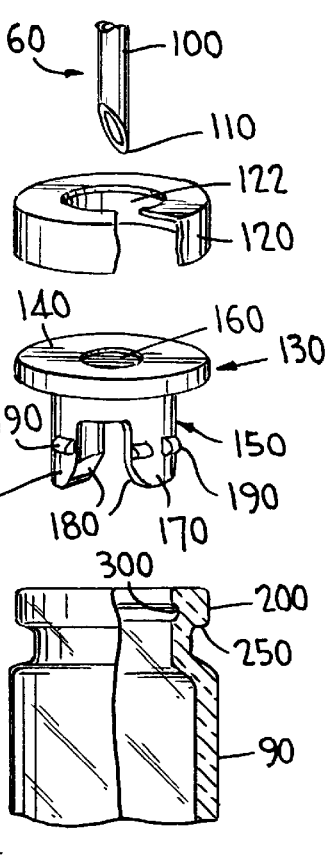
FIG. 3 is a partial side perspective view of the cap portion of the vial with a seal insert.

The upper hollow tube body 40 is integrally formed with a lower annular snap ring 50 provided for connecting the vial access spike adapter 10 to a vial 30. The annular snap ring 50 may have a plurality of slots 52 located around the perimeter thereof which allow the annular snap ring 50 to be snap fitted onto the cover 120 (shown in FIG. 3) of a vial 30.

As the annular snap ring 50 is snapped onto the cover 120 of the vial 30, the slots 52 allow for the annular snap ring 50 to expand to a size larger in diameter than the cover 120 and neck 310 of the vial 30. When the annular snap ring 50 has been snapped over the cover 120, the annular snap ring 50 returns to its relaxed state as the lower end comes to rest in a trough 320 that extends around the perimeter of the neck 310 of the vial 30.

The annular snap ring 50 has an internal annular bead 330 at its lower end which fits within the trough 320 of the neck 310 of the vial 30 to keep the vial access spike adapter 10 in place on the vial 30 helping to maintain a sanitary environment within the vial 30 even when the vial access spike adapter 10 is connected to the vial 30.

The vial access spike adapter 10 is used to not only connect the pump dispenser 20 with the vial 30, but also serves as a conduit to guide and facilitate the dip tube 80 into the vial 30.

The vial access spike adapter 10 has a central passage means 290 which facilitates the placement of the dip tube 60 within the interior of the vial 30 and helps to maintain a sealed and sanitary connection. The central passage means 290 is comprised of an upper, larger tubular section 220, a middle graduated section 230 and a lower, smaller section 240. The upper section 220 has a greater diameter than that of the lower, smaller portion 240. The graduated middle section 230 allows for the transition from the larger, upper section 220 to the lower, smaller section 240 to be smooth and continuous. The central passage means 290 allows for the dip tube 80 to be easily placed within the upper, larger portion 220 and easily guided through the graduated middle section 230 into the smaller, lower section 240.

The central passage means 290 is also supported within the upper portion of the annular snap ring 50 with a central support 340. The plug 130 forms a seal around the lower, smaller section 240 after the lower, smaller section 240 has penetrated the septum 160 in the seal insert 130 thereby avoiding leakage from the vial 30 even if the assembly is tipped or tilted.

The lower end of the lower, smaller portion 240 of the central passage means 290 (FIG. 2) has a sharp, piercing end 60 that is used to perforate the septum 160 of the seal insert 130 in a vial 30. The sharp, piercing end 60 is tapered forming a barbed or perforating end 110 at its apex. This barbed end 110 punctures the septum 160 when axial force is applied to the vial access adapter 10.

Vial 30 has a seal insert 130 placed within the mouth thereof that seals off the vial 30 and prevents the contents of the vial 30 from spilling or leaking and also from being contaminated from pollutants.

The seal insert 130 has an outer wall 140 of a circular, flat, disc shape which is integrally formed with a lower insertion portion 150. The lower insertion portion 150 is cylindrically shaped, having a slightly smaller diameter compared to the neck 310 of the vial 30 and has a plurality of legs 170 depending from wall 140 and which may be tapered as at 180 at one end. The taper 180 allows for the legs 170 to be squeezed together while being inserted into the vial 30. Around the outside perimeter of the lower, insertion portion 150 are spaced a plurality of tabs 190.

The tabs 190 are used to provide a snug fit between the seal insert 130 when it is placed within the mouth and neck 310 of the vial 30. The seal insert 130 also has a septum 160 located in the central portion of the top 140. The septum comprises a membrane of standard material that forms a seal for the vial 30, but which is easily punctured with the insertion of the barbed end 110 of the piercing tube 60.

The lower, smaller portion 240 of the central passage means 290 also channels the dip tube 80 securely into the vial 30.

Figure 4:
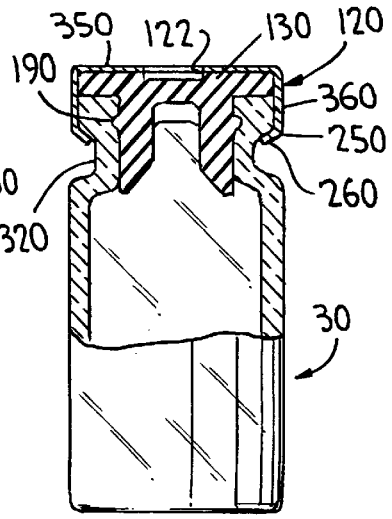
FIG. 4 is a cross-sectional view taken along line 4—4 in FIG. 3, showing the seal insert within the vial and the cap on the vial.

As shown in FIG. 4, the seal insert 130 is held in place by resilient legs 170 and tabs 190 on the inside of the neck 310 of the vial 30 as well as by a cover or crimp seal 120 on the exterior of the vial 30. The cover 120 has a top portion 350 with a central aperture 122 that allows for the septum 160 to be accessible and a sidewall 360 that is folded or crimped around the neck 310 of the vial 30 to secure the cover 120 in place. The edge 260 of the sidewall 350 is actually bent around the shoulder 250 of the vial 30 and comes to rest within the trough 320.

To assemble the pump dispenser 20 and vial access spike adapter 10, a user grasps the vial 30 in one hand and the vial access spike adapter 10 in the other hand. The user aligns the piercing end 60 of the central passage 290 with the aperture 122 of the cover 120 and presses the barbed end 110 into the septum 160 rupturing it while moving the piercing end 60 into the interior of the vial 30 so as to access the contents therein.

The user continues to push the vial access spike adapter 10 onto the vial 30 forcing the annular snap ring 50 to expand around the neck 310 of the vial 30 until the lower end of the annular snap ring 50 comes to rest within the trough 320 of the vial 30. This snap fit arrangement of the annular snap ring 50 on the neck 310 of the vial 30 holds the vial access spike adapter 10 securely in place on the vial 30.

The user then releases the vial access spike adapter 10 and with the same hand grasps the pump dispenser 20. The user places the lower end of the dip tube 80 within the upper end of the vial access spike adapter 10 and pushes the dip tube, while simultaneously guiding it into the opening of the upper section 220 of the central passage means 290. As the pump dispenser 20 is pushed down onto the vial access spike adapter 10, the dip tube 80 is guided through the middle section 230 of the central passage means 290 into the smaller section 240 until it comes out the lower end of the smaller section 240 and extends into the interior of the vial 30.

The user then connects the pump dispenser 20 to the vial access spike adapter 10, in this embodiment by threading the collar 210 to the upper end of the hollow tube body 40.

After assembly as aforedescribed, the contents of the vial 30 can be dispensed by the user simply by depressing the head 370 of the pump dispenser 20 in the usual pumping motion which causes the contents of the vial 30 to be evacuated up through the dip tube 80 and expelled through the pump dispenser 20 in a fashion that is common in the art of pump dispensers.

It is foreseeable that various types of common dispensers other than the fine mist sprayer and pump dispenser described herein could be used without departing from the scope of the invention. Also, various types of connecting devices may be used other than the annular snap ring 50 and the threaded connectors. An alternative embodiment may also combine the seal insert 130 with the vial access spike adapter 10 into a single unit.

Although particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A vial access spike adapter for use with a pump dispenser and a vial, comprising:

a hollow, tubular body having a connecting means at one end for connecting said vial access spike adapter to the pump dispenser;

an annular snap ring at the opposite end of said tubular body from said connecting means, said annular snap ring for connecting said vial spike adapter to the vial;

a guide means comprising a hollow tube within said tubular body and said snap ring, said guide means for guiding a dip tube of the pump dispenser through the hollow tube into the vial; and a portion of said guide means forming a piercing tube for piercing a septum of the vial;

wherein said vial access spike adapter is capable of being connected to the pump dispenser and the vial thus allowing for contents of the vial to be easily dispensed from the vial.

2. The vial access spike adapter according to claim 1, wherein:

said hollow tube guide means having a diameter smaller than the diameter of said tubular body.

3. The vial access spike adapter according to claim 2, wherein:

said guide means having an upper section and a lower section;

said upper section of said guide means having a diameter greater than the diameter of said lower section.

4. The vial access spike adapter according to claim 1, wherein:

said hollow tube guide means has a middle section between said upper section and said lower section;

said middle section of said hollow tube guide means graduating in diameter from said greater diameter of said upper section to a smaller diameter of said lower section;

wherein said greater diameter of said upper section of said guide means allows for the dip tube of the pump dispenser to be easily inserted into said guide means, said graduated diameter of said middle section of said guide means directs the dip tube into said smaller diameter of said lower section and eventually out into the interior of the vial.

5. The vial access spike adapter according to claim 4, further comprising:

a central support for supporting said guide means and providing a seal to prevent leakage of the contents of the vial when said vial spike access adapter is connected to the vial.

* * * * *